US006523554B1

(12) United States Patent
Bryant, Sr.

(10) Patent No.: US 6,523,554 B1
(45) Date of Patent: Feb. 25, 2003

(54) STREET SEWER PASSIVE CLEAN-OUT SYSTEM

(76) Inventor: Harvey J. Bryant, Sr., 930 Storer Ave., Akron, OH (US) 44320

( * ) Notice: Subject to any disclaimer, the term of this patent is extended or adjusted under 35 U.S.C. 154(b) by 119 days.

(21) Appl. No.: 09/656,086

(22) Filed: Sep. 6, 2000

(51) Int. Cl.[7] ..... B08B 9/04

(52) U.S. Cl. ..... 134/104.4; 134/111; 134/167 C; 134/168 C; 210/162; 15/302; 15/104.31; 15/104.32

(58) Field of Search ..... 134/104.4, 110, 134/166 C, 167 C, 168 C, 169 C; 210/154, 162, 190, 191; 15/104.31, 104.32, 302

(56) References Cited

U.S. PATENT DOCUMENTS 3,600,225 A * 8/1971 Parmelee ..... 134/10
3,658,589 A * 4/1972 Shaddock ..... 134/10
4,134,174 A * 1/1979 Flynn et al. ..... 134/104.4
4,234,980 A * 11/1980 DiVito et al. ..... 134/168 C
4,578,198 A * 3/1986 Schmidt et al. ..... 134/10
5,068,940 A * 12/1991 Sheppard et al. ..... 134/167 C
5,129,957 A * 7/1992 Sheppard et al. ..... 134/10
RE34,585 E * 4/1994 Schmidt, Jr. et al. ... 134/167 C
5,643,445 A 7/1997 Billias et al. ..... 210/162
5,849,181 A 12/1998 Monteith ..... 210/163
5,904,842 A 5/1999 Billias et al. ..... 210/162
5,922,197 A 7/1999 Sparks ..... 210/232
5,946,767 A * 9/1999 Sinz ..... 134/109
6,013,138 A * 1/2000 Sinz ..... 134/10

* cited by examiner

*Primary Examiner*—Randy Gulakowski
*Assistant Examiner*—Joseph Perrin
(74) *Attorney, Agent, or Firm*—John D. Gugliotta

(57) ABSTRACT

A street sewer passive clean-out system is provided as a system and method to aid municipal workers in the cleaning of street sewers. A net type screen is provided on the end of a fiberglass pole. The pole would be variable in length from eight feet to sixteen feet. The screen would be available in 7, 9 and 11 inch sizes and would be interchangeable on the end of the pole.

6 Claims, 4 Drawing Sheets

STREET SEWER PASSIVE CLEAN-OUT SYSTEM

RELATED APPLICATIONS

The present invention was first described in Disclosure Document No. 470,189, filed on Mar. 2, 2000. There are no previously filed, nor currently any co-pending applications, anywhere in the world.

BACKGROUND OF THE INVENTION

1. Field of the Invention

The present invention relates generally to include fixed strainer liquid separators and, more particularly, to a telescopingly adjustable sewer filtration means.

2. Description of the Related Art

Whenever a blockage of a municipal sewer system occurs, it must be removed as quickly as possible. This usually means locating the blockage and flushing it out from an upstream access point such as a manhole. A downstream manhole must then also be opened up so the blockage can be trapped and removed so that it doesn't continue blocking downstream pipes. The entering of a manhole by municipal workers is an involved process due to the safety procedures that must be followed. First the manhole must be tested for the presence of hazardous gas. Next a retrieval system which aids in the removal of an unconscious worker may have to be set up. Of course it also requires workers on top as well as those in the manhole. All of this of course translates into increased time and cost.

A search of the prior art did not disclose any patents that read directly on the claims of the instant invention. However, the following references were considered related.

The following patents disclose a sewer and catch basin cleaner including a system for injecting water:

U.S. Pat. No. 6,013,138 issued in the name of Sinz;

U.S. Pat. No. 5,946,197 issued in the name of Sinz;

U.S. Pat. No. 5,922,197 issued in the name of Sparks;

U.S. Pat. No. 5,129,957 issued in the name of Sheppard et al.;

U.S. Pat. No. 5,068,940 issued in the name of Sheppard et al.; and

U.S. Pat. No. 4,134,174 issued in the name of Flynn et al.

And, the following patents describe a debris-removing screen basket for use in a storm collection sewer:

U.S. Pat. No. 5,904,842 issued in the name of Billias et al.;

U.S. Pat. No. 5,849,181 issued in the name of Monteith; and

U.S. Pat. No. 5,643,445 issued in the name of Billias et al.

Consequently, there exists a need for a means by which blockages can be removed from sewer system in a manner which does not require entry into any manholes.

SUMMARY OF THE INVENTION

Therefore, it is an object of the invention to provide for a means by which blockages can be removed from sewer system in a manner which does not require entry into any manholes.

It is a feature of the present invention to provide a telescopingly adjustable sewer filtration means for removing blockages from a sewer system in a manner which does not require entry into any manholes.

Briefly described according to one embodiment of the present invention, the street sewer passive clean-out system is a system and method to aid municipal workers in the cleaning of street sewers. A net type screen is provided on the end of a fiberglass pole. The pole would be variable in length from eight feet to sixteen feet. The screen would be available in 7, 9 and 11 inch sizes and would be interchangeable on the end of the pole. According to an alternate embodiment, a tube type arrangement that is approximately three feet in length. The tube would be available in different diameters to fit the various size sewer lines as mentioned above. Whatever variation is used, the operating principle is basically the same. The invention would be placed in a downstream access point such as a manhole and the sewer line would be flushed from an upstream point. Any large debris would be caught by the invention and simply lifted out. This keeps the workers from having to continually flush the debris through the system thus saving time and money.

The use of the street sewer passive clean-out system provides an alternative means for removing clogging material from sewer lines that is quick, easy and effective.

Advantages of the present invention are many in that it helps to remove and catch foreign matter in sewer systems, prevents workers from having to enter sewers, and thereby increases worker safety and saves time and money.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT AND FIGURES

Figure 1:
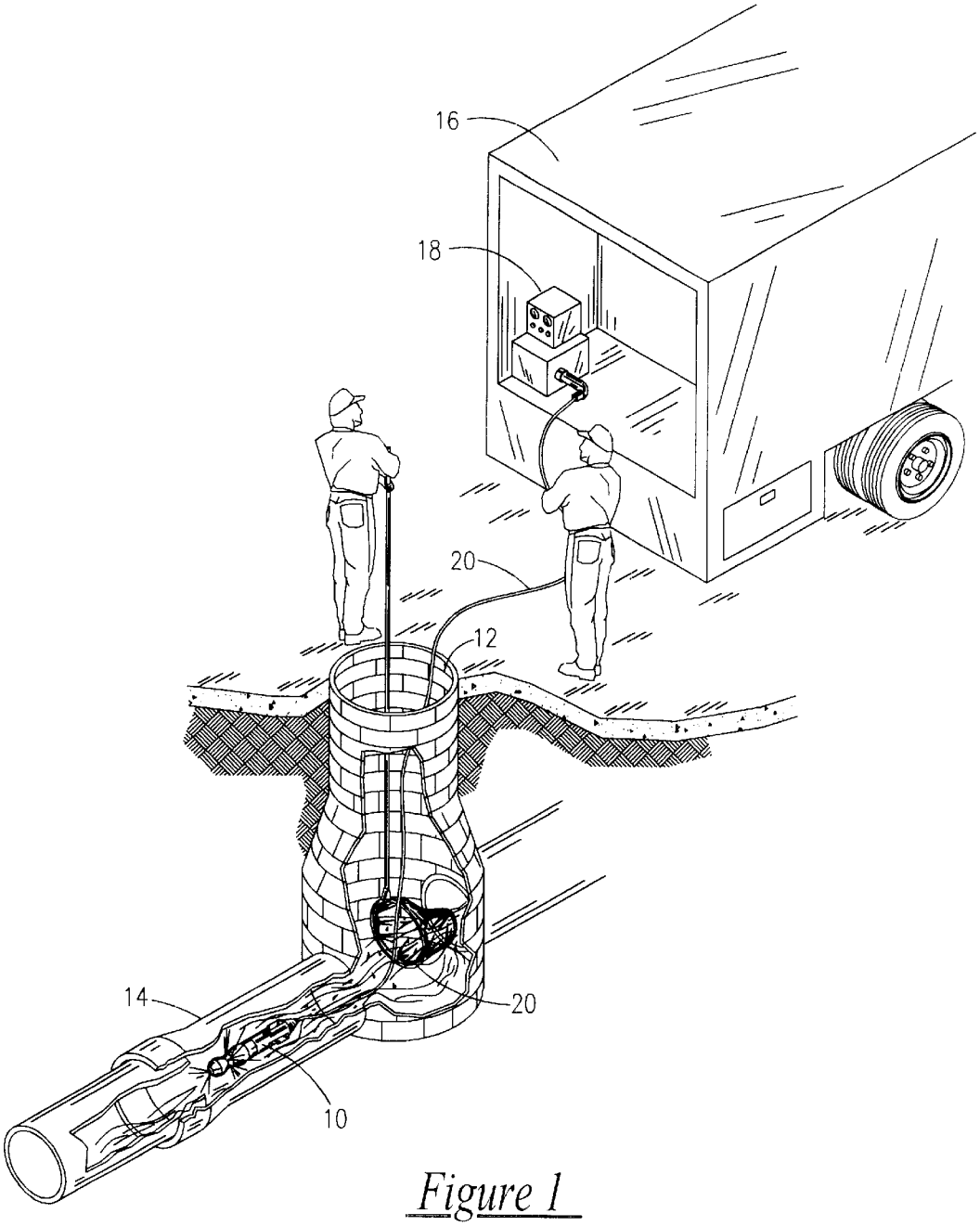
FIG. 1 is a perspective view of a passive sewer cleaning apparatus according to the preferred embodiment of the present invention.
Figure 2:
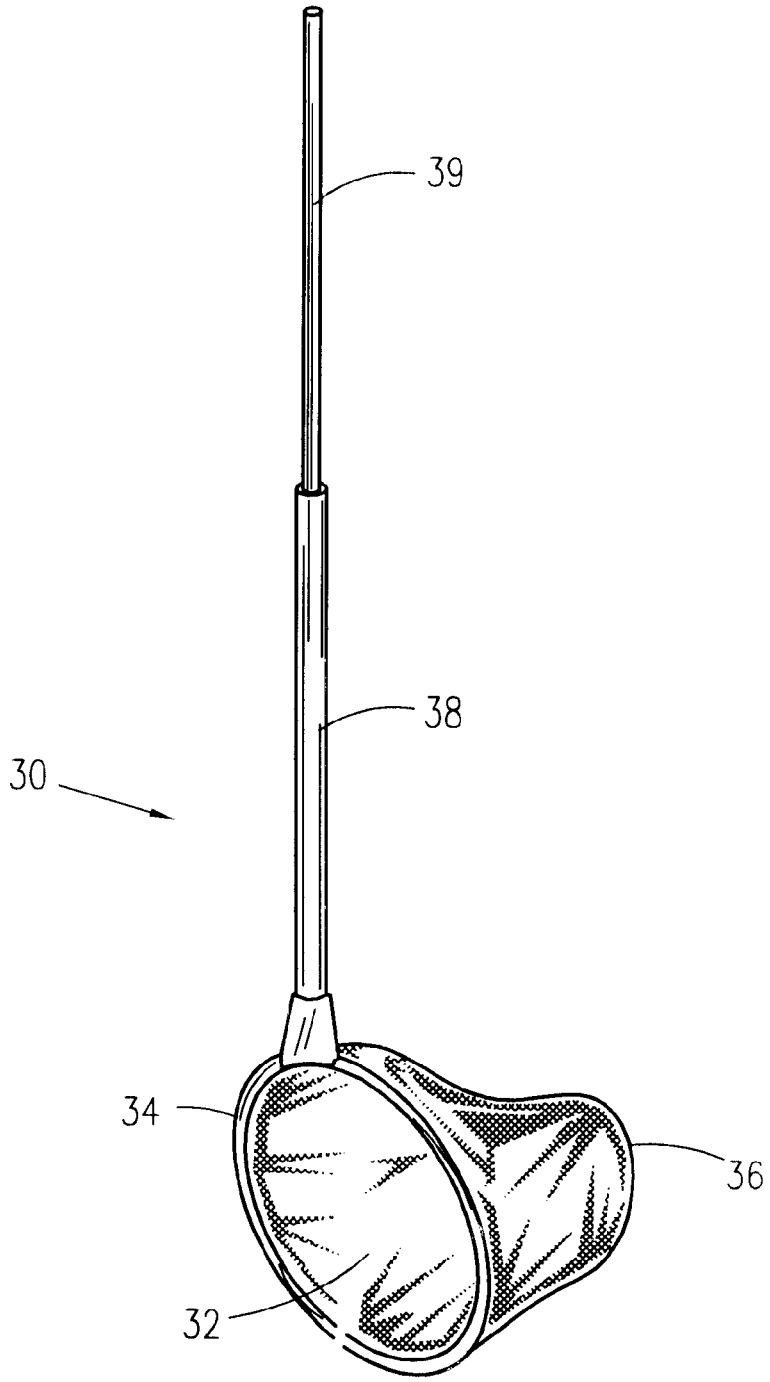
FIG. 2 is a perspective view of a debris collection apparatus 30 for use therewith.
Figure 3:
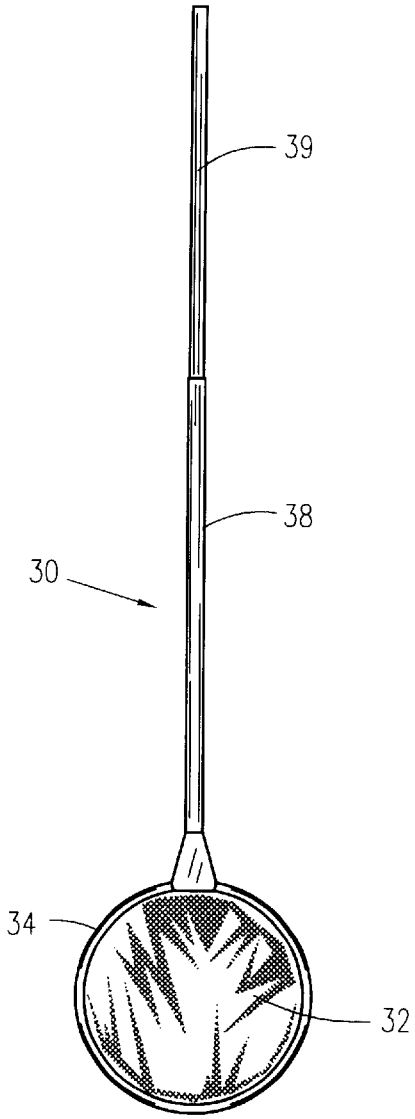
FIG. 3 is a side elevational view thereof.
Figure 4:
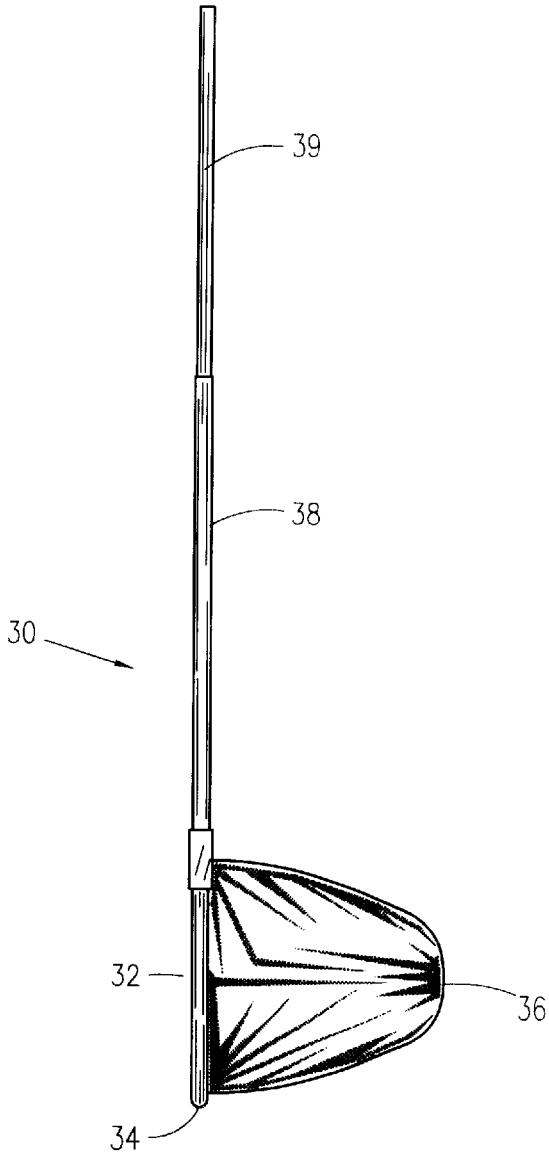
FIG. 4 is a front plan view thereof.

Referring now to FIGS. 1–4, a passive sewer cleaning apparatus is shown and disclosed for providing for removal of debris from a conventional sewer conduit from a remote location, without the user having to enter the conduit. A high velocity sewer nozzle 10 is deployed through a manhole 12 into the conduit 14 and is in communication with an otherwise conventional high velocity cleaner 16 which is a machine designed to remove grease and debris from the small diameter sewer pipes. Such a device is currently utilized, but conventionally by a user who has entered the conduit. It produces jets of high velocity water, also referred to in the art as a jet cleaner, jet water, hydraulic cleaner or high pressure cleaner. It contains a pump 18 for providing 25–30 psi within a deployment line 20 for communication of fluids to the jet nozzle 10. As the nozzle 10 is deployed incrementally laterally within the sewer conduit a debris collection apparatus 30 is additionally deployed down the manhole into the fluidstream in the sewer conduit 14. As shown in conjunction with FIGS. 2–4, the debris capture apparatus 30 is designed to acquire any material in waste water from floating, suspended, entrained or settled on the bottom of the sewer conduit. Such material may cause blockages or stoppages by getting hung up on protrusion or settling out in the sewer. The debris includes grit, paper, plastic, rubber, salt and all materials except fluids. The debris collection apparatus 30 is comprised of an annular ring orifice 32 having a netting material 34 affixed circumscribed around the outer annular circumference forming an elongated netting extension 36 closed at the opposite end. The netting extension 36 is formed of a netting material having a particular pore size selected to allow for the free flowing of fluid through while retaining, through impingement, solids or other matter intended to be removed from the fluid stream. Affixed to on radial point of the outer ring circumference is an elongated extension member 38 formed by telescoping or threading the connected multi-part extension rod 39 designed to extend or adapt in order to allow the user to penetrate the depth of the manhole from the surface in order to reach the sewer conduit without descending into the manhole.

Figure 5:
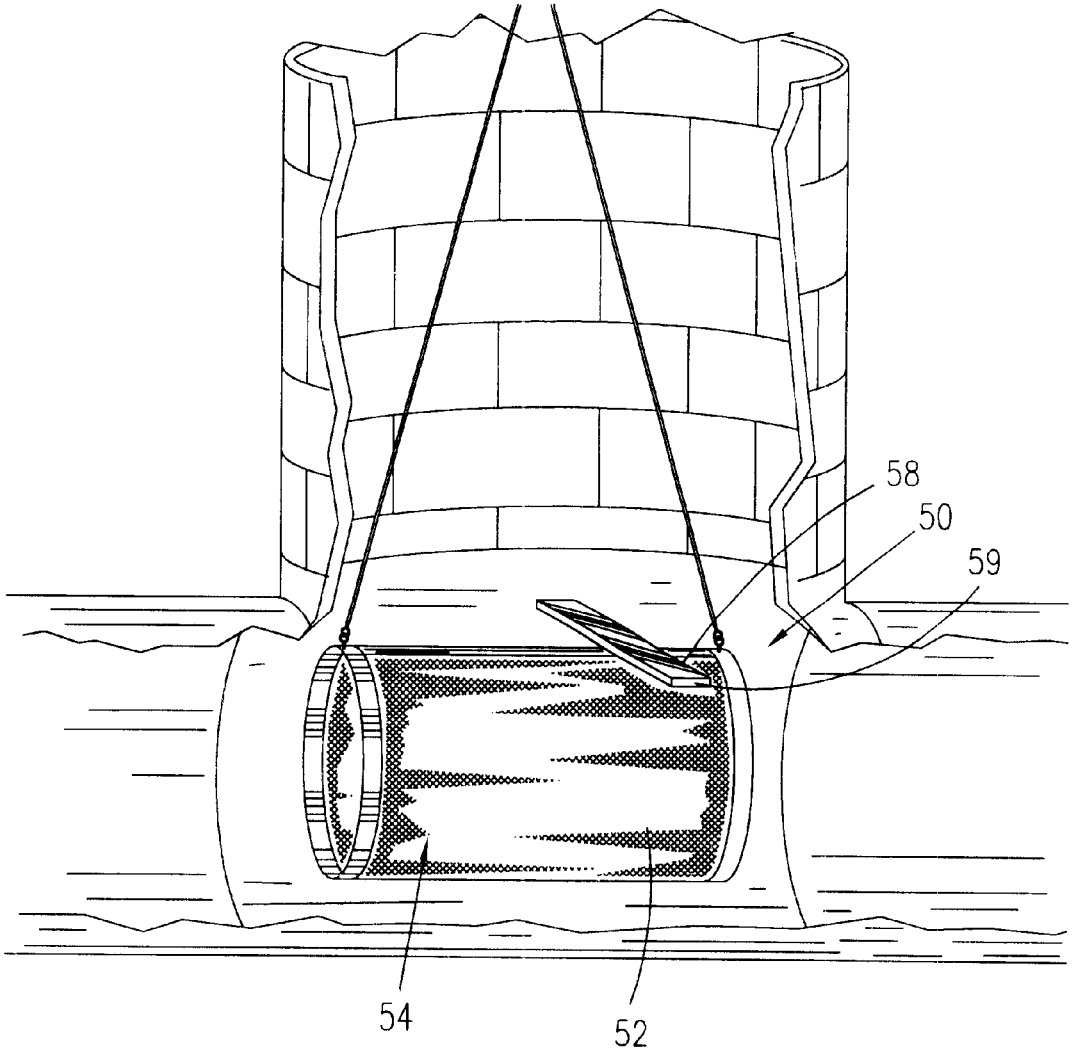
FIG. 5 is a side elevational view showing a first alternate embodiment of a debris collection apparatus for use therewith.

As shown in conjunction with FIG. 5, and alternate embodiment for a debris capture apparatus 50 is designed similarly to acquire any material in waste water from floating, suspended, entrained or settled on the bottom of the sewer conduit. Such material may cause blockages or stoppages by getting hung up on protrusion or settling out in the sewer. The debris includes grit, paper, plastic, rubber, salt and all materials except fluids. The debris collection apparatus 50 is comprised of a tubular, pipe sidewall 52 having a screen material 54 affixed circumscribed around the rear orifice opening. The screen material 54 is formed having a particular pore size selected to allow for the free flowing of fluid through while retaining, through impingement, solids or other matter intended to be removed from the fluid stream. Affixed to on radial point of the outer sidewall is an elongated extension member 58 formed by telescoping or threading the connected multi-part extension rod 59 designed to extend or adapt in order to allow the user to penetrate the depth of the manhole from the surface in order to reach the sewer conduit without descending into the manhole.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A passive sewer cleaning apparatus for providing for removal of debris from a conventional sewer conduit from a remote location, said apparatus comprising:

a sewer nozzle in communication with a fluid discharge type sewer cleaner, said nozzle capable of being deployed through a manhole into a sewer conduit and wherein jets of high velocity water is transmitted from said fluid discharge type sewer cleaner to said sewer nozzle, a debris collection apparatus for collecting any material in waste water from floating, suspended, entrained or settled on the bottom of the sewer conduit, wherein said debris collection apparatus comprises a cylindrical tube member having a netting material affixed circumscribed around a rear orifice circumference opposite a front orifice.

2. The passive sewer cleaning apparatus of claim 1, wherein said debris collection apparatus further comprises:

an elongated extension member affixed to a radial point of a cylindrical tube member sidewall.

3. The passive sewer cleaning apparatus of claim 1, wherein said extension member comprises a multi-part extension rod.

4. The passive sewer cleaning apparatus of claim 1, wherein said debris collection apparatus further comprises:

an annular ring orifice having a netting material affixed circumscribed around an outer annular circumference forming an elongated netting extension closed at the opposite end.

5. The passive sewer cleaning apparatus of claim 4, wherein said debris collection apparatus further comprises:

an elongated extension member affixed to a radial point of the outer ring circumference.

6. The passive sewer cleaning apparatus of claim 4, wherein said elongated netting extension comprises a multi-part extension rod.

* * * * *